US007329212B2

(12) United States Patent
Roque

(10) Patent No.: US 7,329,212 B2
(45) Date of Patent: Feb. 12, 2008

(54) MULTI-EXERCISE ROTARY DEVICE

(76) Inventor: Aldrin Roque, 14 Lewis La., Sparta, NJ (US) 07871

( * ) Notice: Subject to any disclaimer, the term of this patent is extended or adjusted under 35 U.S.C. 154(b) by 15 days.

(21) Appl. No.: 11/012,019

(22) Filed: Dec. 14, 2004

(65) Prior Publication Data

US 2006/0128534 A1 Jun. 15, 2006

(51) Int. Cl.
*A63B 21/22* (2006.01)
*A63B 21/06* (2006.01)

(52) U.S. Cl. ..... 482/110; 482/93

(58) Field of Classification Search ..... 482/81–82, 482/110, 106–108, 93; 446/242
See application file for complete search history.

(56) References Cited

U.S. PATENT DOCUMENTS

| | | | | | |
|---|---|---|---|---|---|
| 169,625 | A | * | 11/1875 | Crandall | 482/81 |
| 3,756,597 | A | * | 9/1973 | Monti | 482/106 |
| 4,043,553 | A | * | 8/1977 | Suarez | 482/110 |
| 4,177,985 | A | * | 12/1979 | Hlasnicek et al. | 482/82 |
| 4,513,963 | A | * | 4/1985 | Nelson et al. | 482/110 |
| 4,787,623 | A | * | 11/1988 | Cedar | 482/81 |
| 4,978,123 | A | | 12/1990 | Ashihara | 273/73 R |
| 5,190,491 | A | * | 3/1993 | Connelly | 446/242 |
| 5,362,059 | A | | 11/1994 | Grossman | 273/186.2 |
| 5,478,297 | A | | 12/1995 | Dennis, Jr. | 482/82 |
| 5,895,341 | A | | 4/1999 | Jones | 482/81 |
| 5,904,640 | A | | 5/1999 | Shahinian | 482/110 |
| 6,022,300 | A | * | 2/2000 | Hightower | 482/106 |
| 6,524,226 | B2 | | 2/2003 | Kushner | 482/126 |
| 6,595,900 | B1 | | 7/2003 | Cook | 482/82 |

* cited by examiner

*Primary Examiner*—Fenn C. Mathew
(74) *Attorney, Agent, or Firm*—Lawrence C. Edelman, Esq.

(57) ABSTRACT

A multi-exercise rotary device, comprising: at least one elongate body-supported member, the body-supported member having a first end adapted to be supported by the body of the user, and a second end opposite the first end, at least one rotating member having a longitudinal axis that is at least semi-rigid, and which axis has a weight-biased distribution toward a distal end thereof; and a rotary mechanism for coupling the rotating member to a point on the body-supported member which is near the second end thereof. The rotary mechanism allows rotational movement of the rotating member about the longitudinal axis of the body-supported member. The rotary mechanism includes a device for constraining the angular movement between the weight-biased longitudinal axis of the rotating member and the longitudinal axis of the body-supported unit to be substantially only in a predetermined plane axially aligned with the body-supported member, and for constraining said plane from twisting with respect to the longitudinal axis of said body-supported member.

20 Claims, 16 Drawing Sheets

Fig. 33
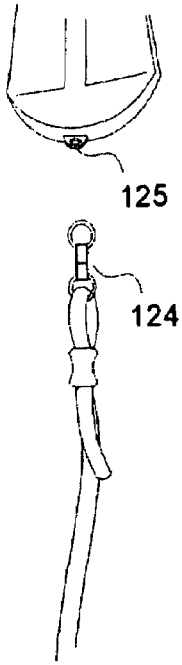
Fig. 34
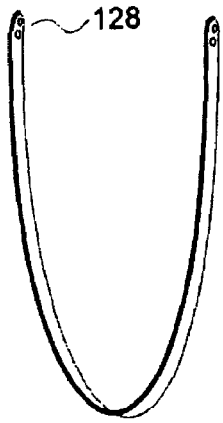
Fig. 35A
Fig. 35B
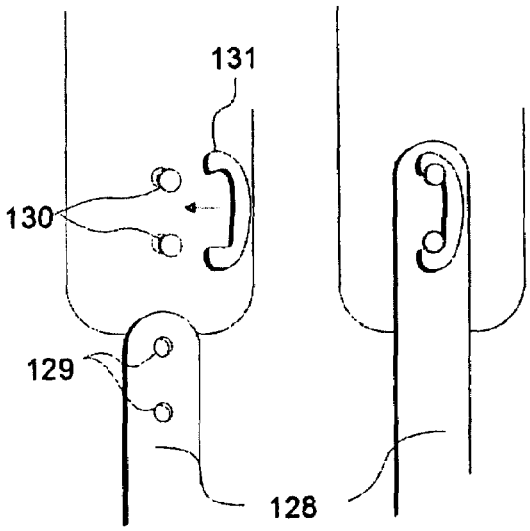
Fig. 36
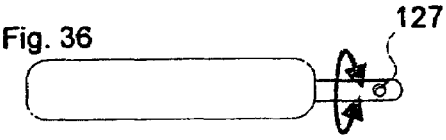
Fig. 37
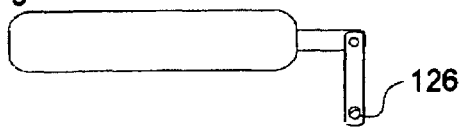

MULTI-EXERCISE ROTARY DEVICE

BACKGROUND OF THE INVENTION

1. Field Of The Invention

The present invention relates generally to rotary exercise devices, and more specifically, to a body supported rotary exercise device that can be used alone or in pairs, that is safe to use, especially in confined quarters or group environments, has minimal space requirements, and provides a plyometric upper and lower body workout through the use of adjustable centrifugal weight and/or adjustable rotary resistance.

2. Discussion of Background and Prior Art

Jump ropes and jump rope simulators have been used for years and known in prior art as one of the most effective and powerful means of conditioning. They are known to provide amazing plyometric strength building and cardiovascular benefits, and are supported by studies claiming that regular use promotes increased metabolism, rapid fat loss and increased bone density.

Both jump ropes, jump rope simulators and air resistance training devices heretofore devised and utilized are known to consist of basically familiar, expected and obvious structural configurations, not withstanding the myriad of designs encompassed by the crowded prior art, which have been developed for the fulfillment of countless objectives and requirements. Unfortunately, these devices have some drawbacks.

Jump ropes in general can be cumbersome, dangerous and difficult to use in group classes or settings, requiring ample floor space and ceiling height. Jump rope simulators offer some options in the way of space restrictions and coordination constraints, but still fall short when it comes to adjustment and safety features. This becomes more apparent when performing heavy rope exercises where the centrifugal weight of the swinging member is increased.

Body supported or hand held air resistance devices have been typically geared towards training the user to swing a swung object such as a racket, bat or golf club. The goal is to perfect a single swing thereby focusing on form and quality of the entire swinging movement, from start to finish, rather than on quick, continuously repetitive plyometric strength-building movements where the focus is conditioning and fat burning. The other devices that use air resistance means are machines or fixtures that are stationary. They are usually stationary bikes or gym equipment that uses rotary resistance to provide a linear form of resistance through pulleys, gears or axels.

U.S. Pat. No. 5,895,341 discloses a jump rope simulator that consists of a pair of hand held devices that utilize a lumens or cord filled with weight at the free end to generate the required inertia for swinging. In general, jump rope-type devices with separate handles are not as well suited for centrifugal weight adjustment as bar-type jump rope devices. These devices can also be dangerous if there is a substantial increase in centrifugal weight, since there is a limited amount of impact absorption offered by the lumens or cord. In addition, lumens or cord type jump rope simulator devices do not lend themselves to offering much in the way of adjustable rotational resistance. Any other rotational resistance offered by these devices, outside the initial force required to generate momentum and start rotation, is related to drag produced by the radial surface length of the lumens or cord. Therefore, as the radial length increases, the chance of striking a person or object also increases. Thus, safety becomes an issue.

U.S. Pat. No. 5,904,640 discloses an extended rotator device that can simulate a bar-type jump rope. Bar-type jump ropes only offer a limited range of motion and work a limited number of muscles.

U.S. Pat. No. 6,524,226 discloses an exercise device that converts from an elastic resistance-training device to a swinging jump-rope simulator by disengaging a connection means at the center of the elastic member, whereby the device can be used as two hand held units having separate free elastic ends that can be swung in the manner of a jump rope. This device fails to provide adjustable centrifugal weight for swinging. Furthermore, since the device is used to perform exercises based on two different principals-linear resistance vs. repetitive plyometrics, shortening the length of the elastic would have a negative impact on the resistance band exercises, while the relatively long elastic becomes cumbersome when used as a swinging-type device, especially in confined quarters or group environments. Furthermore, the gauge or elasticity of the bands must be taken into consideration when increasing centrifugal weight since bands will have a tendency to elongate or stretch during swinging.

SUMMARY OF THE INVENTION

In view of the foregoing disadvantages inherent in the different types of jump ropes including both the bar-type and without bar, jump rope simulators, including both the bar-type and without bar, and swinging air resistance exercise devices now present in the prior art, the new invention provides a new multi-exercise rotary device for providing both an aerobic and anaerobic exercise workout that can safely simulate the jumping of a jump rope as well as allow the user to perform non-traditional jump rope movements and positions. As a jump rope simulator, the present invention is able to offer a workout free from the constraints of actually having to jump over a physical rope, a major obstacle that must be overcome before a user can achieve any type of workout using a jump rope.

As compared to other jump rope simulators, the present invention includes a rotating member that is able to have a relatively shorter radial length than a jump rope or typical jump rope simulator, due to the imparting an adjustable rotational resistance to the rotating member. This shorter radial length makes the present invention better suited for use in more confined quarters or group environments. The rotating member has a rigid or semi-rigid planar construction that is light-weight, impact absorbing, and safe. The imparting of the rotational resistance can be due to the air-drag created by the rotation of the planar surface of the rotating member, alone or in combination with the use of a rotational friction generating device. The imparting of an adjustable rotational resistance to the rotating member, makes the rotary exercise device of the invention better able to simulate the feel of a much longer rope or cord swinging through the air.

Furthermore, the planar surface of the invention's rotating member is able to provide a secondary progressive cooling effect, as a result of air displacement toward the user. For example, the rotating member can be an airfoil such as a propeller or combination of propellers arranged in a circular design, to help redirect air current. Since jump rope type exercises can be very intense, this cooling effect enhances performance by increasing comfort and helping prevent overheating or heat exhaustion of the user. Air current directed towards the user increases as the user works harder, providing for a more comfortable workout at higher intensities and longer durations. Furthermore, when the invention is used in opposite pairs the invention creates two separate currents of air, thereby doubling the cooling effect.

The general purpose of the present invention, described subsequently in greater detail, is to provide a multi-exercise rotary apparatus and method which has many of the advantages of traditional jump ropes, jump rope simulators and airfoil devices known heretofore, and many novel features that result in a new multi-exercise rotary device which is not anticipated, rendered obvious, suggested or even implied by any of the prior art.

To attain this, the present invention generally comprises at least one body-supported unit. The body-supported unit comprises an elongate body-supported member, having a first end adapted to be supported by the body of the user, and a second end including a rotating member. A rotary mechanism couples the rotating member to the body-supported unit, and allows rotational movement of the rotating member about the longitudinal axis of the body-supported unit. The rotary mechanism includes a pivot for constraining the angular movement between the longitudinal axis of the rotating member and the longitudinal axis of the body-supported unit. Additionally, a user adjustable means is provided for allowing the user to adjust the rotational resistance of the rotating member about the longitudinal axis of the body supported member. These components of the rotary mechanism produce the centrifugal and rotational resistance required in the workout. In one embodiment the rotating member has a planar surface, and the pivot constrains the orientation of the planar surface to be a substantially fixed angle relative to the direction of rotation. In a further preferred embodiment the rotary mechanism comprises a hinge member coupled for rotational movement about the second end of the body-supported unit. In an even further preferred embodiment, the body-supported unit is hand held and typically can be used in opposite pairs.

BRIEF DESCRIPTION OF THE DRAWINGS

These and other advantages of the invention will become apparent upon reading the following detailed description and upon referring to the drawings in which:

FIG. 8 illustrates a rotary mechanism where the rotating member spins about an axis that is stationary relative to the body supported member, by means of a bearing assembly. FIG. 9 illustrates a rotary mechanism whereby the axis spins on a bearing assembly. Both figures illustrate the ability to change attachments.

FIGS. 33 to 37 illustrate embodiments of the multi-exercise rotary device showing various rope or cord attachments that allow the device to be converted into a standard jump rope.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

The present invention is a Multi-exercise rotary device supported by a body part, such as a hand or leg, of a user. The rotary exercise device provides a workout based on the user performing repetitive rotational movements so as to generate inertia in order to keep one or more of the component members of the device spinning (FIGS. 1-4). The Multi-exercise rotary device can be used to isolate a single appendage, such as a single hand-held unit in order to perform an exercise designed to rehabilitate a rotor cuff injury. When more than one rotary exercise device is used at the same time, the user can target multiple appendages in order to increase workout intensity, and obtain strength building, injury rehabilitation and cardiovascular benefits.

The rotary exercise device and cited attachments can be adjusted so that exercises can be performed in a variety of arm or leg positions to target specific muscles and muscle groups used to support or move the appendage, such as the deltoids, triceps, pictorials, gluteus, abdominals and quadriceps. The user can perform an exercise with a single or plurality of hand-held units (FIGS. 1, 2A and 2B) in conjunction with other exercises, such as aerobic step routines, running, jogging, skipping, jumping or sit-ups.

Figure 3A:
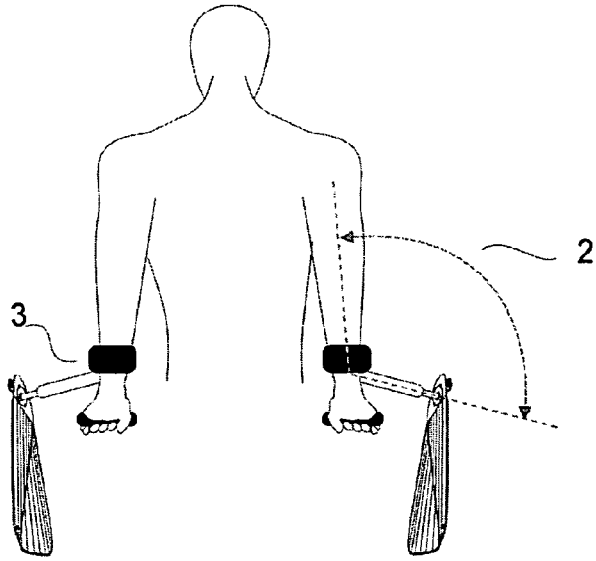
FIGS. 3A and 3B illustrates another embodiment of a multi-exercise rotary device coupled to the users appendage by means of a brace attachment.
Figure 3B:
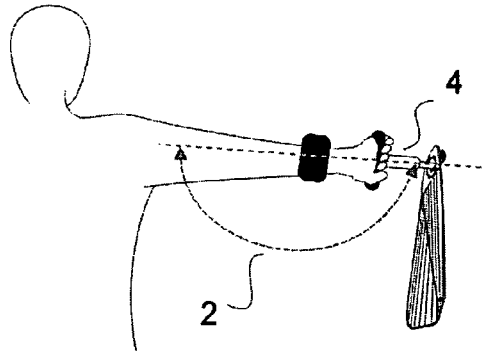
Figure 4:
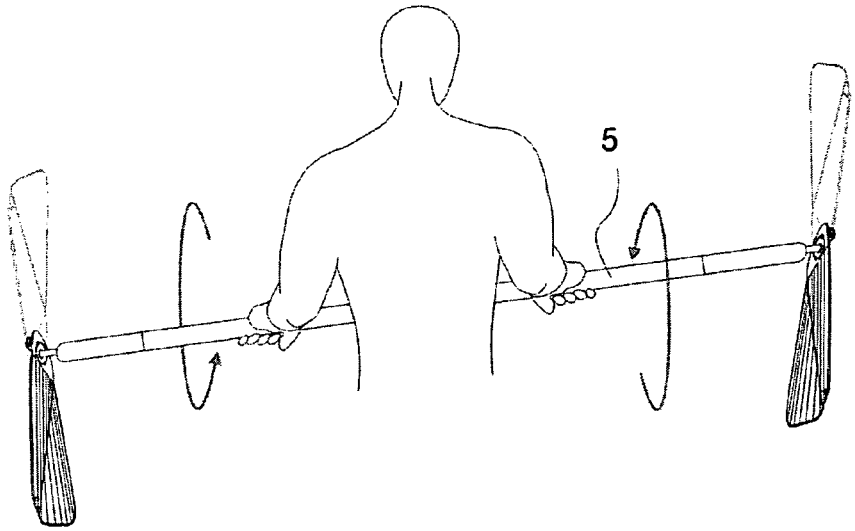
FIG. 4 illustrates another embodiment of a multi-exercise rotary device wherein opposite pairs of the multi-exercise rotary device are coupled together by means of an extension member attachment and used to perform rowing or paddling type exercises.
Figure 5:
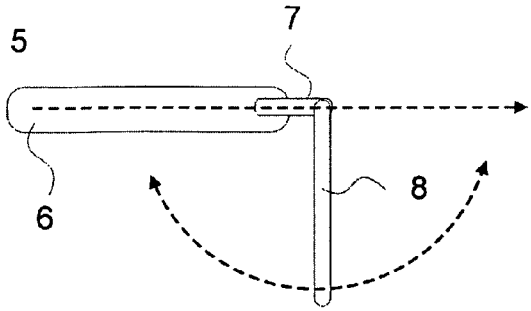
FIG. 5 illustrates shows the body supported member and pivot orientation.

The rotary exercise device can be attached to any part of a user's appendage, such as an arm and or leg, using a brace attachment or similar coupling method (FIGS. 3A and 3B). Two units can be used in unison to simulate various jump rope and "jump rope-like" exercises as well as non conventional, jump rope movements and positions due to the independent action of each body supported unit as well as the short radial length of the rotating member. Single or multiple hand-held units can be coupled together using an extension member attachment (FIG. 4) such as a rod or shaft, allowing the user to perform a variety of exercises that simulate paddling and pedaling activities like rowing a boat, or alternate paddling a kayak.

Although in this description the term "hand held" is often used when referring to an embodiment of the invention, it is to be understood that this term is not to be considered as limiting the use of the invention to only hand-held devices. This convenient term is used only to aid clarity, and as noted herein, the invention is not limited to hand-held environments, since it can be supported by other body parts such a forearm, or leg, as desired.

The Basic Components and How They Function Together

A multi-exercise rotary device, comprising:

at least one elongate body-supported member, said body-supported member having a first end adapted to be supported by the body of the user, and a second end opposite the first end;

at least one rotating member having a longitudinal axis that is at least semi-rigid, and which axis has a weight-biased distribution toward a distal end thereof;

a rotary mechanism for coupling the rotating member to a point on the body-supported member which is near the second end thereof, said rotary mechanism allowing rotational movement of the rotating member about the longitudinal axis of the body-supported member; and a device for constraining the angular movement between the weight-biased longitudinal axis of the rotating member and the longitudinal axis of the body-supported unit to be substantially only in a predetermined plane axially aligned with the body-supported member, and for constraining said plane from twisting with respect to the longitudinal axis of said body-supported member.

These components of the rotary mechanism produce the centrifugal and rotational resistance required in the workout.

In one preferred embodiment the rotary mechanism includes a pivot (FIG. 8, reference 11 or FIG. 9, reference 12) for constraining the angular movement between the longitudinal axis of the rotating member and the longitudinal axis of the body-supported unit, and also includes a means for providing user adjustable rotational resistance of the rotating member about the longitudinal axis of the body supported member.

In another preferred embodiment, the rotating member has a planar surface, and the pivot of the rotary mechanism constrains the orientation of the planar surface to be a substantially fixed angle relative to the direction of rotation.

Figure 6:
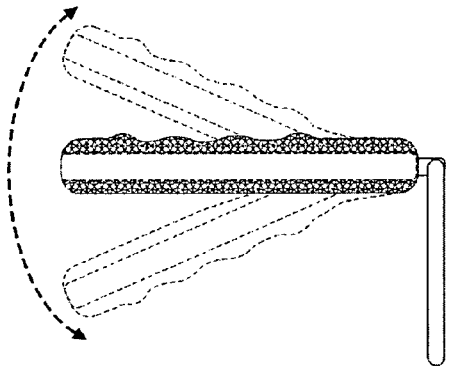
FIG. 6 illustrates a cross section of a hand held body supported member that is flexible and has a compressible outer layer and a contoured gripping surface.
Figure 12:
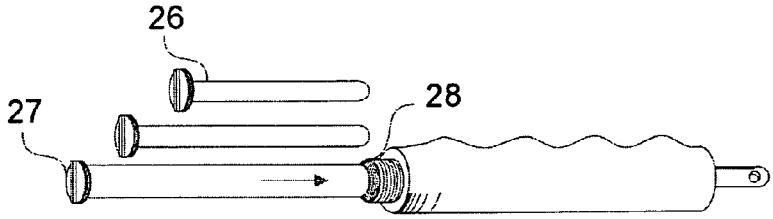
FIGS. 12 and 13 show attachments that can be added to increase the weight of the body supported end of the device.

The body-supported member provides isometric resistance (none or minimal movement) through adjustable flex (such as in FIG. 6 and FIG. 10, reference 17), and provides isotonic resistance (against gravity) through adjustable weight (FIG. 12, reference 38).

Figure 7:
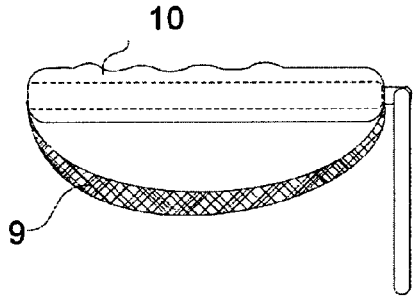
FIG. 7 shows a hand held body supported member with a strap.

In accordance with one aspect of the invention, the body supported member can incorporate a strap (FIG. 7, reference 9), compressible outer layer and contoured gripping surface (FIG. 7, reference 10), in order to facilitate direct support of the member by the hands of the user. Alternatively, the body supported member can be supported indirectly; for example by securing it to an extension member attachment, such as a pole or rod (FIG. 4, reference 5), which rod is then gripped by a body portion, such as by one or both of the user's hands. A single or plurality of hand-held devices could be used with the extension member. The extension member can have adjustments for grip variation, weight resistance, and overall length.

In accordance with another aspect of the invention, the body supported member can also be secured to a limb using a brace attachment (FIGS. 3A and 3B). In one embodiment the brace may aid in or eliminate hand gripping and provide variations in grip, weight resistance, angle (FIG. 3A, reference 2 and FIG. 3B, reference 2) and placement orientation to the user's limb (FIG. 3A, reference 3 and FIG. 3B, reference 4). Both extension member and brace attachments are designed to work in conjunction with the hand-held exercise device as an enhancement or alone as a weight lifting aid or device. Both attachments can provide a variety of complimentary anaerobic exercises during interval training workouts, where the user alternates between the hand-held exercise device and other exercises and/or devices.

In accordance with a further aspect of the invention, the axis extends from one end of the body supported member and supports the rotating member and other spinning parts. The axis allows the rotating members to be detached so that different rotating member attachments can be used. By detaching the rotating members (such as members 15 and 16 of FIGS. 8 and 9), two hand-held exercise devices may be coupled to various other types of attachment members, such as a jump rope attachment (FIGS. 8 and 9, references 15 and 16) that allows a pair of hand-held units to be used as a traditional jumping rope device.

Figure 8:
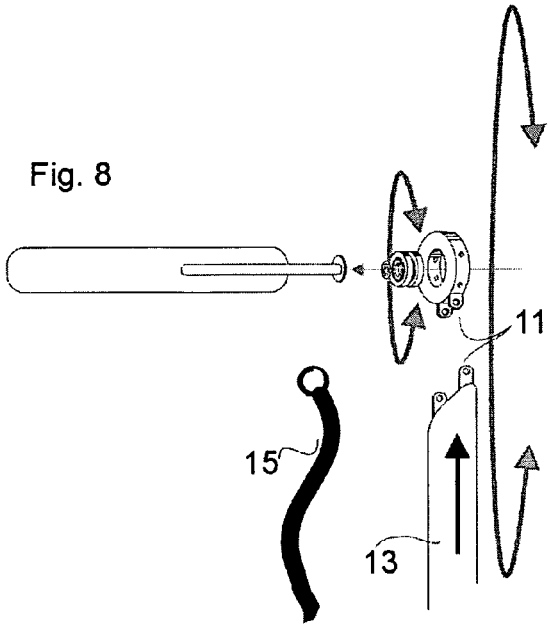
FIGS. 8 and 9 illustrate two types of axes.
Figure 9:
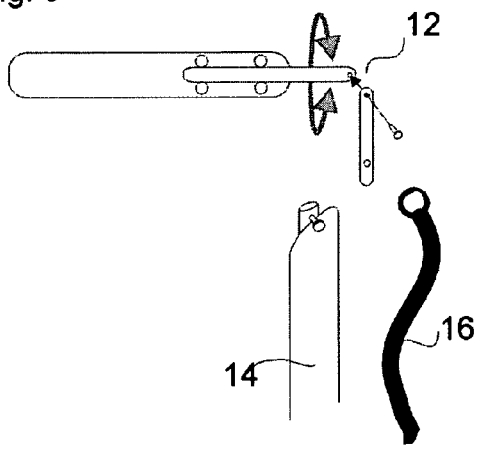

In accordance with the invention, the pivot is preferably located between the axis and the end opposite the free-end of the rotating member. The pivot provides the centripetal motion allowing a longitudinal axis of the rotating member to move linearly towards or away from the longitudinal axis of the handle, i.e., the motion of the rotating member is constrained by the pivot to be in a plane that is axially aligned with the longitudinal axis of the handle. This feature allows the rotating member to spin along a rotational plane that does not always have to be perpendicular to the axis of the handle (FIG. 1) so that using the hand-held exercise device feels natural when held at different angles. The pivot is preferably located close to the axis and in one embodiment may even provide the means by which to detach the rotating component member from the rest of the hand-held exercise device, as shown in FIGS. 8 and 9 by references 11 and 12. Furthermore, the pivot may be designed into the rotating member, where a portion of the rotating member can flex in the cited manner, such as by using springs. The pivot may also be coupled with an attachment member such as a jump rope attachment (FIG. 9, reference 16) that allows a pair of two hand-held units to be used as a traditional jump rope device.

The rotating member provides Isokenetic benefits (progressive resistance) through adjustable centrifugal weight, radial position of the centrifugal weight, overall radial length and rotational resistance. In embodiments of the invention where the pivot is incorporated into the design of the rotating member, the rotating member can be removably attached to the pivot or removably attached to the axis. The rotating component member can be rigid or semi rigid in the direction of rotation, whereby the rotating member resists wrapping itself around the axis. This feature is important for the effective use of friction applied to or near the axis to slow rotation.

In accordance with another aspect of the invention, a small lightweight light source can be attached or connected to the rotating member. This attachment projects a single or multiple beams of light. The light or lights project a beam that can be used to visually cue the user as to the orbital position of the rotating member, for visual stimulation, as a means of triggering a sensor on an external computational device or any combination. Any number of methods may be used to limit the range by which light is projected to prevent the light from shinning in someone's eyes. For example, an encoder on the rotating member may cause the light device, which is located on the handle and facing the ground, to turn on and off as the rotating member passes the ground. Light can also be blocked out mechanically, where a structure that surrounds a light source that spins with the rotating member only allows light to pass through an opening, which faces the ground. In addition, power to the light source can be supplied either through a rechargeable or replaceable battery, or through use whereby the user's repetitive movements cause the rotary mechanism in the invention to spin and create electricity like a generator.

Thus, as described above, the combination of rotational resistance, centrifugal weight and the ability to have a radial length of less than 2½ feet, while still able to recreate the same feel of a jump rope, makes the exercise device of the present invention a viable alternative to traditional jump ropes and long jump rope simulators, especially when used in confined areas and group environments such as the work place or exercise classes where others or objects may come into the trajectory of the rotating member.

Figure 50A:
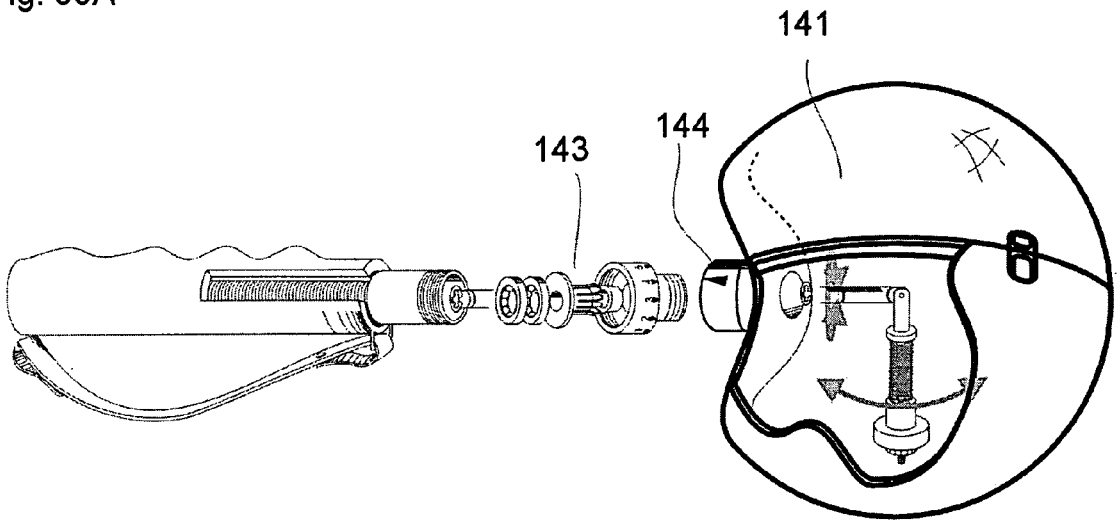
FIG. 50 illustrates embodiments of the multi-exercise rotary device wherein the rotary mechanism is housed in an enclosure.

Additionally, the ability to exercise one limb at a time and in different positions makes the rotary exercise device of the invention a very versatile and functional alternative to many strength and cardiovascular exercise devices. To help prevent injury or damage to the surroundings, the rotating member may be constructed from or incorporate a design utilizing soft, impact absorbing materials. Further more, the rotating member may be encased in an enclosure to isolate it from the immediate surrounding area during use (as shown in FIG. 50*a*, reference 141).

In accordance with the invention, the effect of rotational resistance is key to controlling the rotating member as it spins, especially as the radial length of the rotating member is shortened, making it more difficult for the user to quickly decelerate or maintain a slower rate of rotation. Rotational resistance can be achieved through air drag or air displacement which acts on the surface area of the rotating member, and/or relative friction between the rotating and non-rotating parts of the hand-held unit. Both may be implemented together in any combination.

Figure 1:
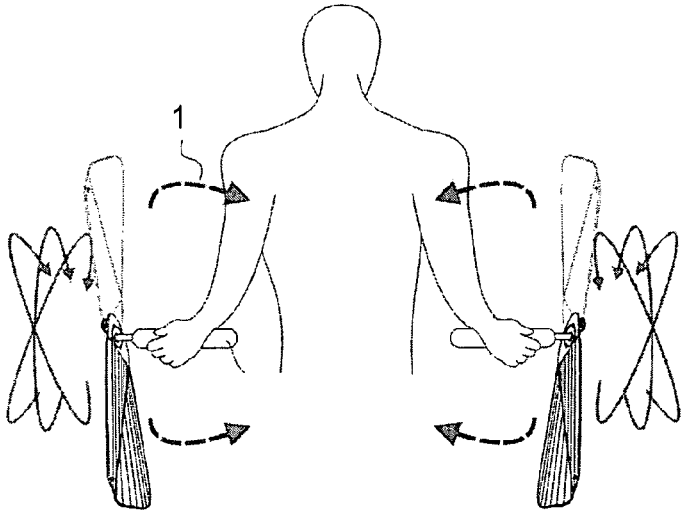
FIGS. 1 and 2A-2C illustrate an embodiment of a multi-exercise rotary device constructed and operating in accordance with the principles of the present invention.
Figure 2A:
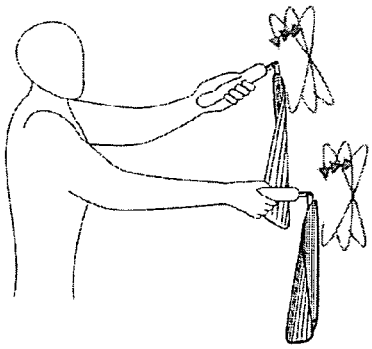
Figure 2B:
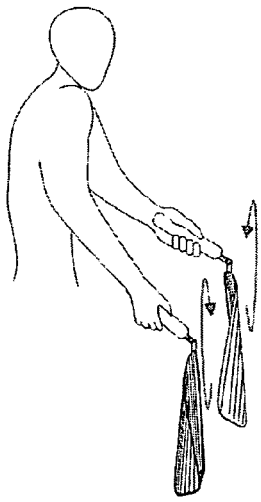
Figure 2C:
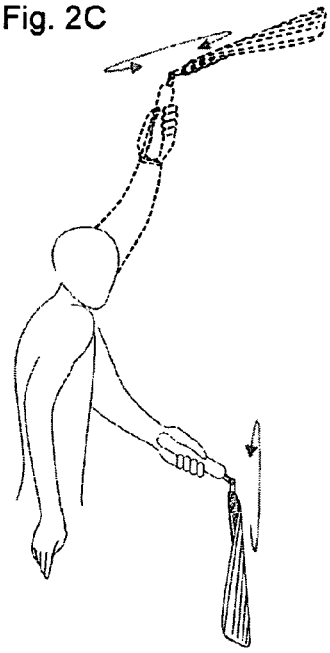

Progressive resistance is naturally achieved using air drag or air resistance. An added benefit of using air displacement for progressive resistance is the ability to redirect airflow towards the user creating a fanning or cooling affect during the workout (FIG. 1-1). When using friction, progressive resistance can be achieved by utilizing the centrifugal force generated by any number of rotating components or parts and transferring that force to a friction generating mechanism. As the centrifugal force increases, so does the friction between the rotating and non-rotating parts.

Rotational resistance is also used to simulate the rope or cord of a jump rope hitting the ground. When this occurs, momentum generated by swinging the rope or cord is absorbed or suddenly decreased. This is accomplished in the invention using a variety of methods such as a rack and pawl or friction means applied to a point or section of the rotating member's orbit, specifically towards the ground.

In one embodiment of the invention, the rotary exercise device is fitted with a rotational counter with the ability to generate an audible cue such as a "click" or "beep" sound that lets the user know when a revolution is completed. The rotational counter and the sound generating device can be mechanical or electronic and allows the user to calculate calories burned. Both components can be mounted, for example, on the hand-held member or on the rotating component member depending on the axis design or configuration. The computational device and display may also incorporate an input device such as a keypad that allows the user to input user-specific data that may be used for more accurate calculations. Furthermore, a means for uploading data to an external device may be accomplished using an output cable interface or wireless transmitter.

In accordance with a further aspect of the invention, the rotary exercise device can be used in conjunction with a Multi-Exercise Calorie-Counting Mat. In a preferred embodiment, the calorie counting mat has a composition, which incorporates shock absorbent materials. The mat can be of any shape and size depending on the range of exercises the embodiment is designed to accommodate and provides a means for detecting and counting the steps or jumps of a user. The Calorie-Counting Multi-functional Exercise Mat has a plurality of sensing zones for detecting multiple events at any given point in time. In one embodiment, these zones can be configured to function as a single zone that records a single event in time no matter how many sections are triggered during a given time period. The mat can be set for a given exercise such as jumping rope, jumping jacks or step aerobics.

In one embodiment, the user can associate personal characteristics with use of the mat, such as age, weight, height and/or approximate body fat percentage. Such data is entered and/or computed by a removably connected electronic computational device such as a pedometer, which may be situated internally or externally to the mat. The electronic computational device can calculate calories burned based on time, the number of triggered events on the mat, and/or other relevant information entered by the user. The mat has a digital display that shows user data and information, such as the number of trigger events, calories burned and time elapsed. In addition, it can be programmed for interval training. An optional metronome or beat producing feature with optional music accompaniment can help the user keep a rhythm or pace and vary the workout intensity. The number of intervals, length of each interval, interval intensity and length of a routine can be set. The electronic device gauges the user's performance by comparing the trigger rate with the internal time clock and programmed pace for a given interval.

If a mechanical rotary counter is present on the hand-held exercise device, information can be manually entered into the computational device on the mat at the end of a workout to be factored in for calorie calculations. Various ways of transmitting rotational information from the hand-held exercise device to the mat can be implemented such as a rotary counter with transmitter or a light sensor on the mat that detects light transmitted by the previously cited light attachment.

In a further embodiment, the mat can have a removable stereo system with tuner, tape player, CD player and speakers. It can be connected to an external sound system and accepts headphones. The mat can be connected to a television, which can be used as a monitor when a data CD is inserted into the CD player. The CD player provides an audiovisual component with programmed group workout routines such as a jump rope interval workout that the user can be rated against. In operation, the user tries to follow the exercises routine and keep up with the group shown on the screen. Immediate feedback and final score based on comparing the rate of real time triggered events vs. the routine being played on the CD program is displayed. The cited or implied information shown on the digital display is also shown on the television screen. The term CD and CD player can be substituted with any other data storage and data storage-playing device known and implied.

MORE PREFERRED EMBODIMENTS

Figure 10:
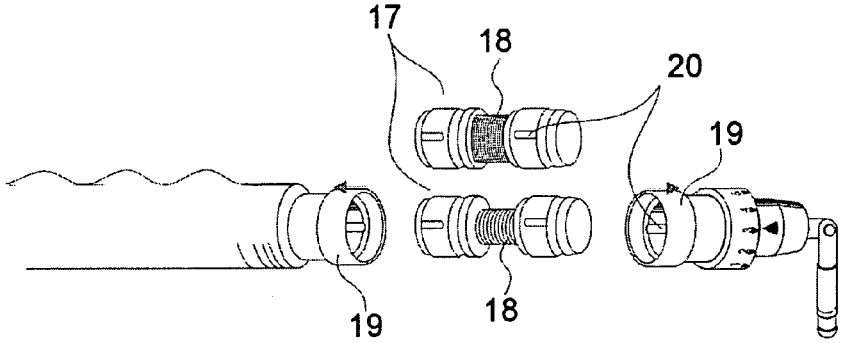
FIGS. 10, 11A and 11B illustrate embodiments of a multi-exercise rotary device where attachments to the body supported member allow the device to flex.

FIG. 10 illustrates a hand-held embodiment of the rotary exercise device of the invention, which demonstrates a three-piece design. Flex of the hand-held member is achieved through a removable middle section (17) that incorporates various spring gauges (18). They connect the two sections of the hand-held member through a variety of means such as a sleeve fitting (19) which may be keyed (20) to prevent spinning. Alternatively, a spring loaded ball retainer could be used to prevent spinning.

Figure 11A:
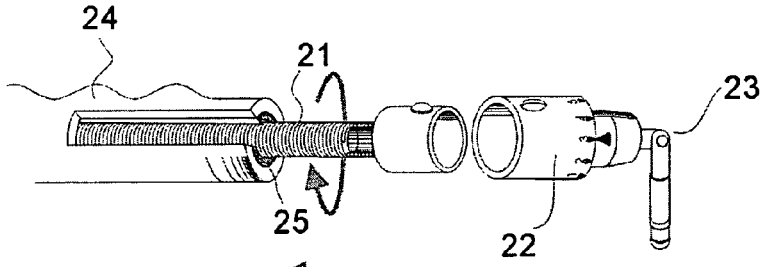
Figure 11B:
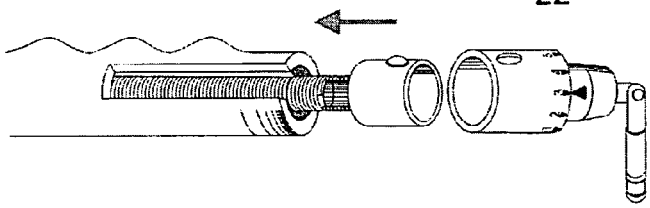

FIG. 11 illustrates a further embodiment, which demonstrates a hand-held member with a two-piece design. An extension spring (21) is permanently fixed to the second piece (22), which connects to the axis (23) and is adjustably inserted into the first piece (24). The distance between the first and second piece can be adjusted by screwing and unscrewing the spring in and out of the first piece, which has a threaded inner surface (25). Retracting or extending the spring causes the tensional load to be applied across different lengths of the spring producing variations in flex. A variety of means can be used to secure the spring and prevent it from extending or retracting while in use. One method uses a collet on the first end located at the point of insertion. Another method uses a screw device on the first end that can be tightened causing the free end of the screw to exert pressure against the spring, locking it in place.

Figure 13:
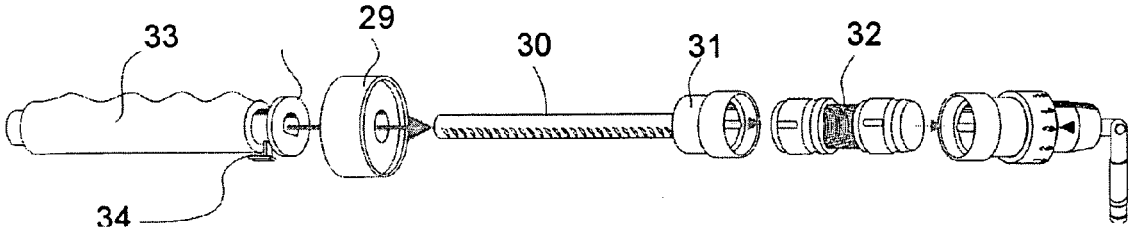

In accordance with the invention, the weight of the hand-held member can be adjusted through a variety of ways. FIG. 12 shows one embodiment where various weight inserts (26. 27) can be applied to the hand-held member and secured by screwing a threaded head on the weight into the threaded end (28) of the hand-held member opposite the axis. FIG. 13 shows another embodiment where a cylindrical weight attachment (29) is inserted over a notched member (30). The notched member extends from a keyed sleeve fitting (31) which is used to connect to the flexible middle section (32) previously cited in FIG. 11. The hand-gripped portion (33) of the hand-held member, which contains a spring loaded finger mechanism (34), slides over the notched or toothed member behind the weight attachment, thereby forming a ratchet. The rack and pawl engage when moved apart, locking the sections together with the weight in the middle. To remove or change the weight, the spring loaded finger mechanism must be depressed to disengage the pawl and separate the two sections.

Figure 14:
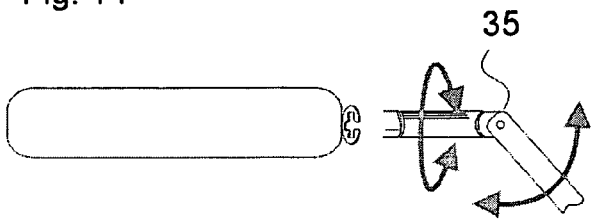
FIGS. 14, 15, 16A-16C, and 17 illustrate embodiments of the multi-exercise rotary device showing different axis-pivot configurations of the rotary mechanism.
Figure 15:
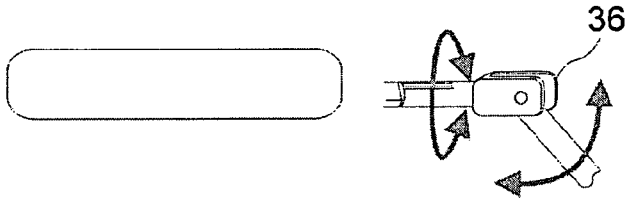
Figure 16A:
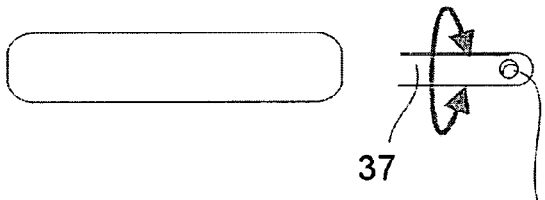
Figure 16C:
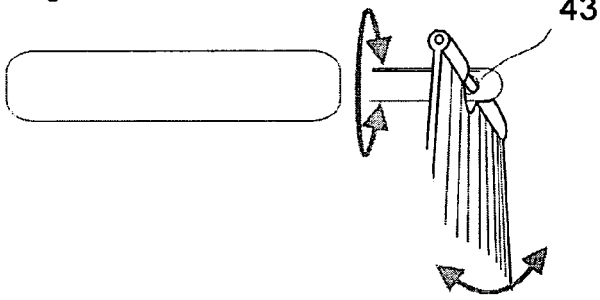
Figure 16B:
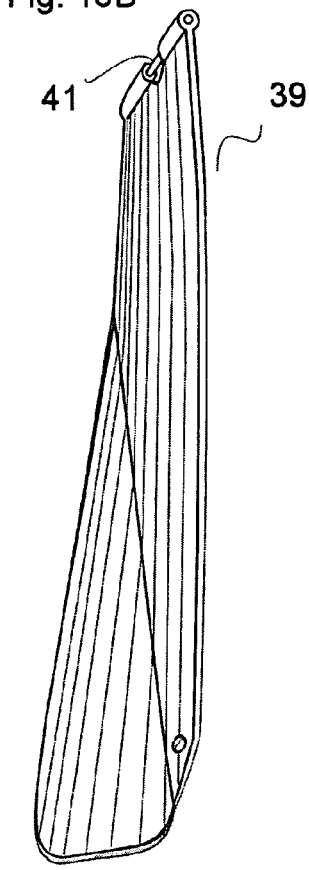
Figure 17:
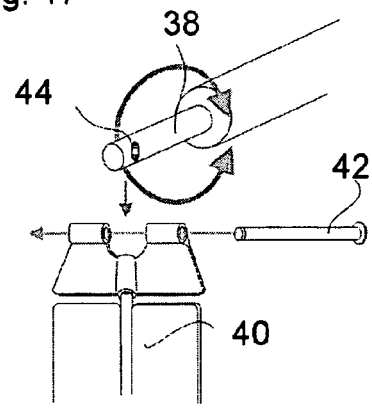

FIGS. 14 to 17 demonstrates axis-pivot configurations of the invention, where the axis spins as part of a bearing assembly such as a brass bearing or ball and race assembly. FIG. 14 shows one embodiment where the axis extends out from the hand-held member to form part of a linkage (35). FIG. 15 shows an embodiment where the axis extends out from the hand-held member to form part of a clevis joint (36). FIGS. 16 to 17 demonstrate a spinning axis design (37, 38) that connects directly to a rotating member (39, 40, respectively). The rotating member uses a removable locking pin (41, 42) at the attached end, which fits into a hole (43, 44) located through the diameter of the axis. Together, the axis and rotating member form the pivot.

Figure 18:
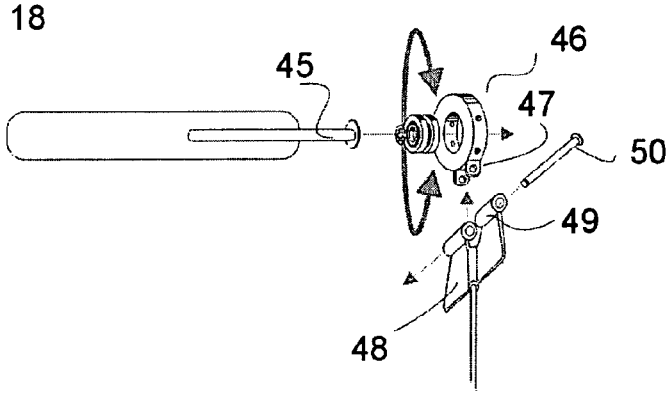
FIGS. 18 to 20 show various methods by which the rotating member can be removably attached to the rest of the rotary mechanism.

FIG. 18 shows one embodiment where the axis (45) is stationary relative to the handle. A ball bearing assembly (46) containing one half of a hinge (47) rotates around the end of the axis and is removably connected to the rotating member (48), which has the other half of the hinge (49). A removable locking hinge-pin (50) connection is utilized to connect the two halves forming the pivot.

Figure 19:
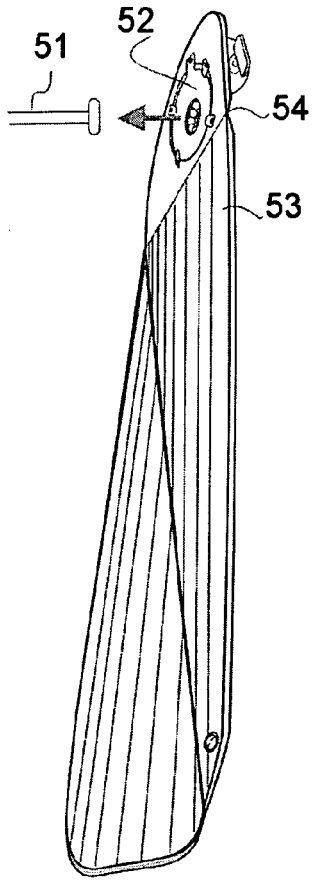

FIG. 19 shows another embodiment that utilizes a stationary axis (51) around which a ball bearing assembly (52) spins while being located within the rotating member (53). The ball bearing assembly is removably inserted into the rotating member. The rotating member has a section (54) near the axis that allows its free end to bend in the previously cited manner to form the pivot.

Figure 20:
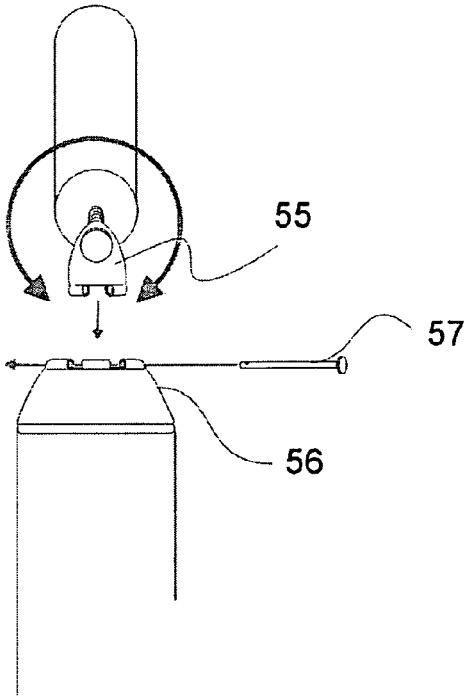

FIG. 20 demonstrates a pivot embodiment in the form of a hinge (55, 56). One half of the hinge (55) is part of the rotating axis assembly and the other half of the hinge (56) is part of the rotating member. This configuration is removably connected using a locking hinge pin (57).

FIGS. 21 to 27 demonstrate a variety of rotating member embodiments showing different ways of achieving air drag or resistance, adjustable centrifugal weight, adjustable radial position of centrifugal weight, and overall radial length.

Figure 21:
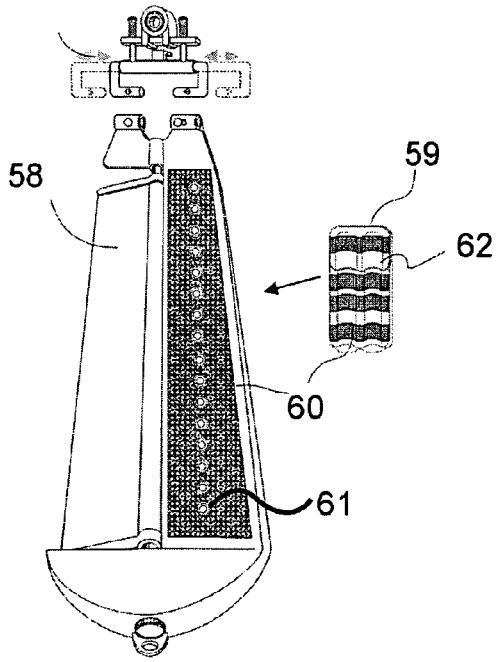
FIGS. 21 and 22 show different methods of increasing centrifugal weight and variable air drag through airfoil adjustments.

More specifically, FIG. 21 shows one embodiment where air resistance is created through an airfoil design. Although some of the following figures show elongated airfoil designs with only one longitudinal axis, other types of airfoils having more than one axis, such as a multi-blade propeller or even a circular airfoil, could also be used. Air resistance can be adjusted by manually changing the angle of a flap (58) on the rotating member. The flap position is adjusted and locked in place by a ratchet, similar to adjustable folding beach chairs currently on the market. The flap uses spring tension to prevent the flap from moving in the non-locking direction without being manually adjusted by the user. In order to move the flap in the locking direction, it must be moved in the unlocked direction until the locking feature disengages. When the locking feature is disengaged, the flap can move in the locking direction. Changing direction will automatically reactivate the locking feature. A weight attachment (59) is radially positioned on the rotating member and attached thereto using Velcro (60) and/or snap fasteners (61). The weight attachment (59) is composed of a soft flat pouch containing flat weight inserts that can be changed or inserted by opening a Velcro flap (62).

Figure 22:
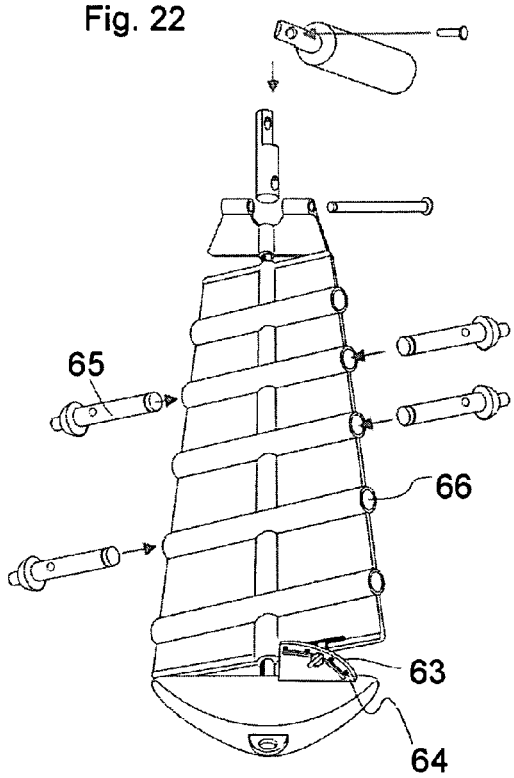

FIG. 22 demonstrates an airfoil embodiment that uses an angle-gauging device (63, 64) similar to that on a protractor. A locking wing nut (63) is used to adjust/set the airfoil flap angle. The adjustment has markings (64) that allow the user to visually gauge and synchronize two hand-held exercise devices. Weight inserts (65) can be positioned and inserted into chambers (66) along the length of the rotating member. The weight inserts are locked in place by any number of means such as screwing or use of a spring-loaded ball retainer.

Figure 23A:
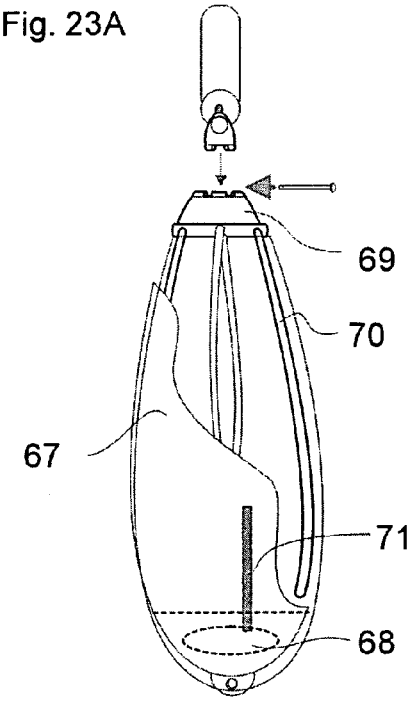
FIGS. 23A and 23B demonstrate an embodiment that incorporates another method of adjusting the surface area of the rotating member in order to create air drag.
Figure 23B:
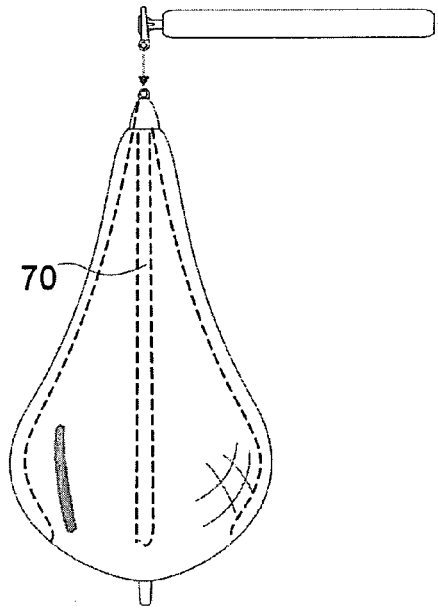

FIG. 23 demonstrates an embodiment where the rotating member is composed of thin pliable planar materials such as cloth, canvas, plastic or rubber, in any combination, in the shape of a pouch or sack (67). The rotating member encases and secures a removable weight (68) at its free end and terminates to a tapered opposite end (69). An internal support structure (70) made of semi rigid or rigid material such as plastic, fiberglass or wire is utilized to help the rotating member keep its shape and prevent torque in the direction of rotation. The internal support structure can be adjusted to increase or decrease the rotating member's volume, allowing the user to adjust the amount of air drag. The weight can be inserted through a zipper opening (71). The removable weight (68) is comprised of a dense weight bearing material or aggregate such as metal, lead, rubber or sand. Padding used to cushion the weight can be composed of any number of impact absorbing materials or structures such as an air bladder, foam or rubber.

Figure 24A:
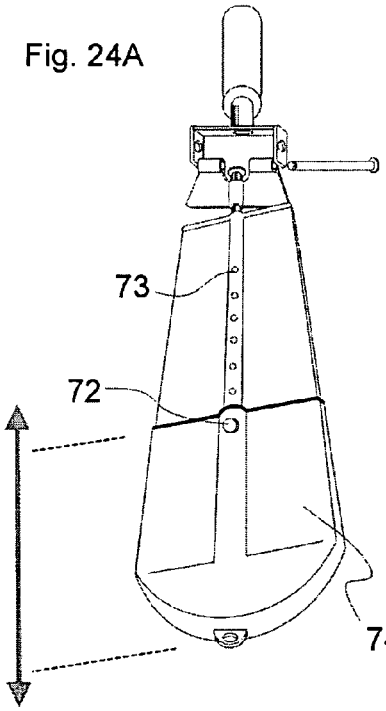
FIGS. 24A and 24B illustrate another embodiment of the multi-exercise rotary device showing radial length adjustment of the rotating member.
Figure 24B:
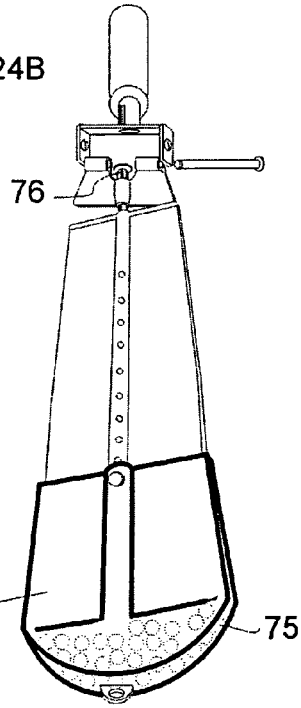

Replacing the rotating members in FIGS. 21, 22 and 23 with longer or shorter replacements allows the user to vary overall length. FIG. 24 shows one airfoil embodiment where overall length can be adjusted using a telescopic design locked in place by a spring loaded pin mechanism (72) and radially positioned holes (73). The free end or segment (74) houses and provides the cushion for the internal weights (75). By moving the free end up and down, radial weight position can be adjusted. Weight pellets (75) can be adding or removed from the free end segment. The rotating member uses a spring loaded, keyed axis rod adjustment (76) allowing the user to set the desired airfoil angle. The user pulls up on the head of the axis rod adjustment, turns it to the desired angle and drops it back in place. Grooves at the opening of the axis rod chamber lock into the corresponding grooves located the top of the axis rod adjustment.

Figure 25B:
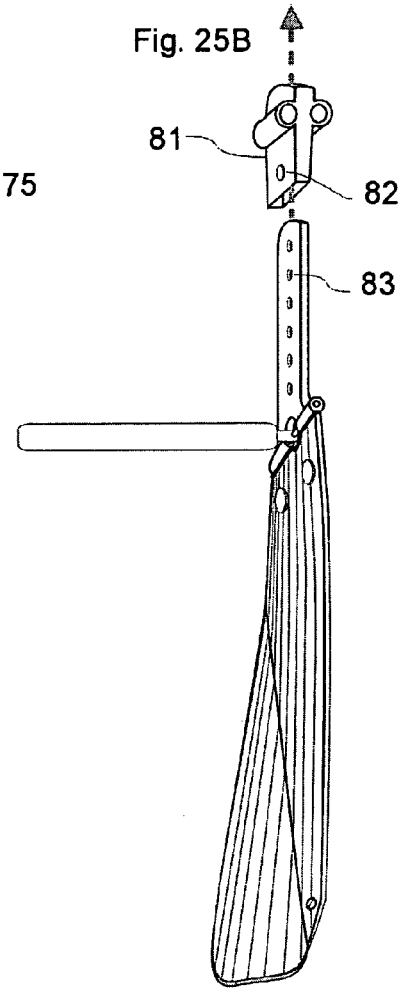
FIGS. 25A and 25B illustrate another embodiment of the multi-exercise rotary device showing a rotating member with more than one swinging end and weight attachment method.
Figure 25A:
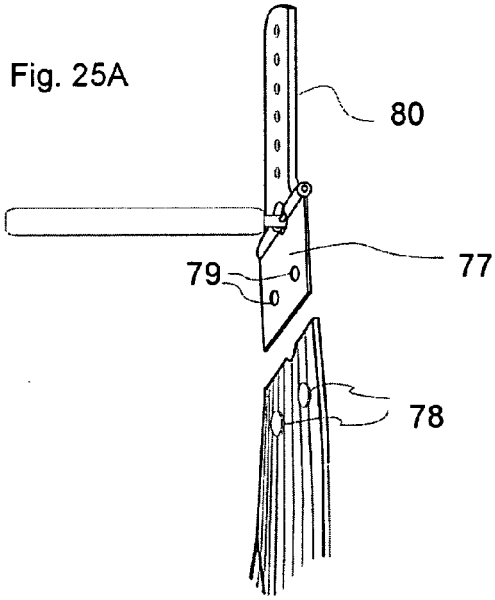

FIG. 25 demonstrates an embodiment where the rotating member has two ends that extend in opposite directions from the axis. One end (77) receives different lightweight airfoil attachments so the user can adjust air drag. The airfoil is locked in place using spring-loaded pins (78) that fit into corresponding holes (79) on the end (77) of the rotating member that attaches to the airfoil. The opposite end (80) is a member that allows a single or plurality of weighted sleeves (81) to be attached. Holes (82) in the end member and spring-loaded pins (83) on the weight attachments allow each sleeve to be secured and radially positioned. The weight sleeves have a cushioned outer layer.

Figure 26A:
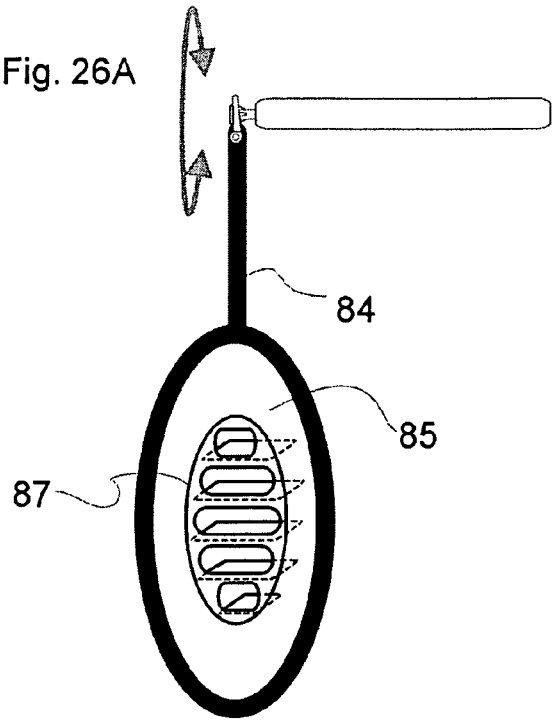
FIGS. 26A and 26B illustrates another embodiment of the multi-exercise rotary device with a rotating member that uses the surface area of a textile or pliable, cloth-like material to create air drag.
Figure 26B:
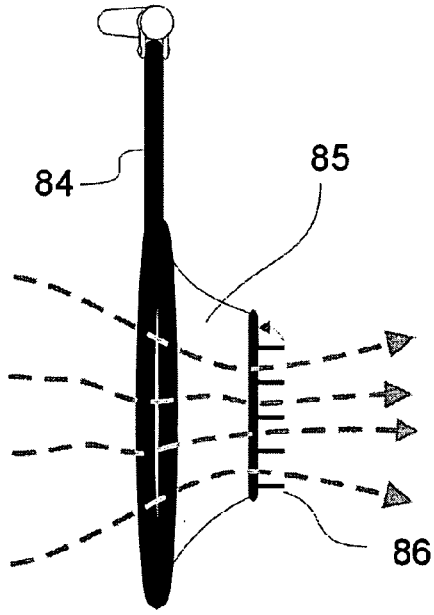

FIG. 26 demonstrates a rotating member embodiment that uses an elliptical frame (84) with a planar surface or membrane (85) to create air drag. The membrane can be rigid, semi rigid or flexible. The rotating member looks similar to a butterfly net. Air drag can be increased or decreased by either opening or closing vents (86) located on a floating center component (87) on the membrane. Other embodiments using the same basic design implement vent flaps oriented vertically where they can be angled so that airflow is directed towards the user.

Figure 27A:
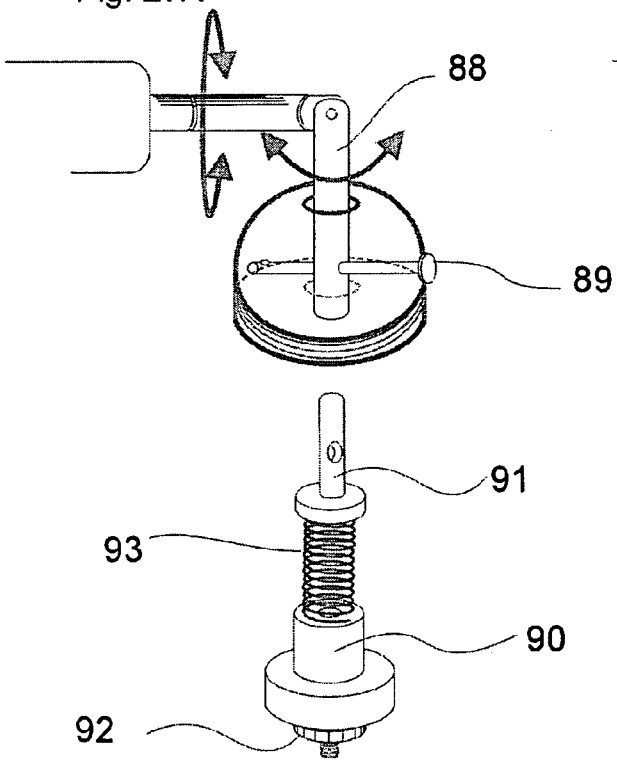
FIGS. 27A and 27B illustrates another embodiment of the multi-exercise rotary device showing a weighted rotating member insulated in padding component.
Figure 27B:
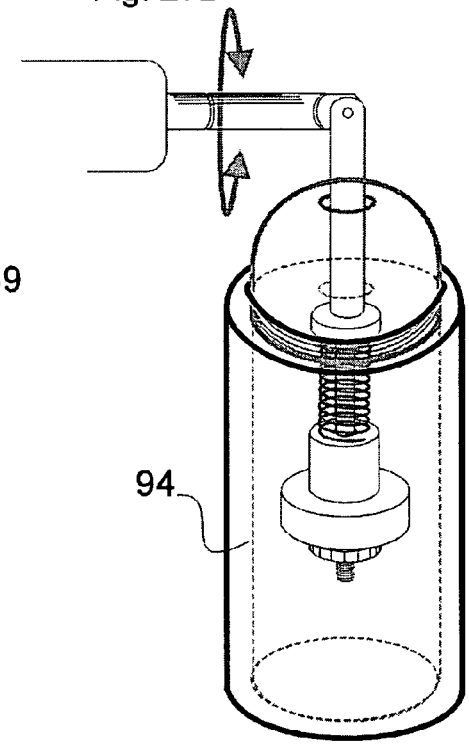

As previously noted, friction can be used in place of, or in addition to, the use of air drag to create rotational resistance. FIG. 27 shows an embodiment of the invention where the one rotating member uses friction in the previously cited manner to achieve rotational resistance. The rotating member is removably attached to a linkage (88) using a locking pin (89) so that it can be interchanged with different length replacement rotating members. Weight attachments (90) slip over a threaded member (91) and are held in place with a locking nut (92). The locking nut allows for radial positioning of the weight and a spring (93) on the opposite side of the weight prevents it from sliding up and down. A cushioned sleeve (94) forms a soft outer layer, which insulates the hardware and protects the surrounding environment.

Figure 28:
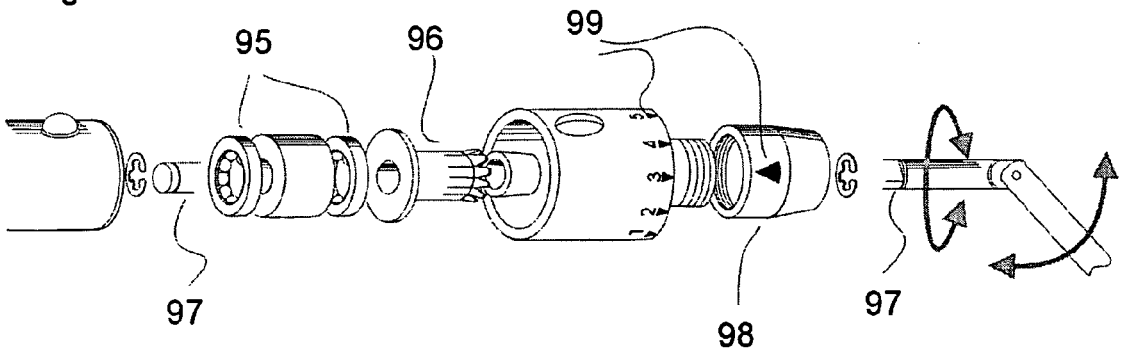
FIGS. 28 to 30 illustrate embodiments of the multi-exercise rotary device whereby a variety of friction means are used to create an adjustable rotational resistance.
Figure 29:
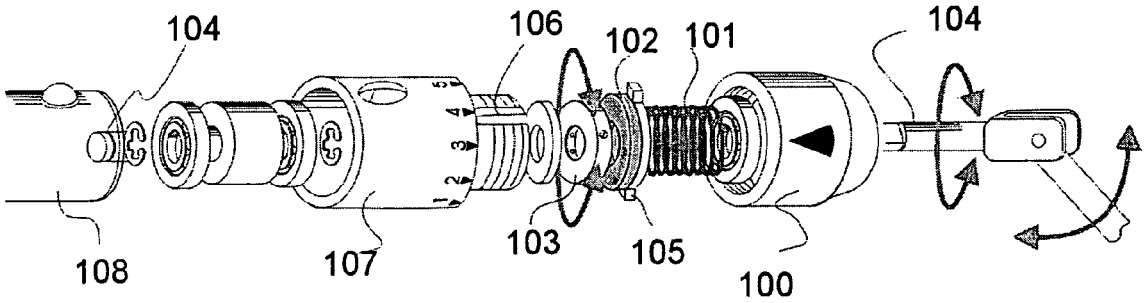
Figure 30:
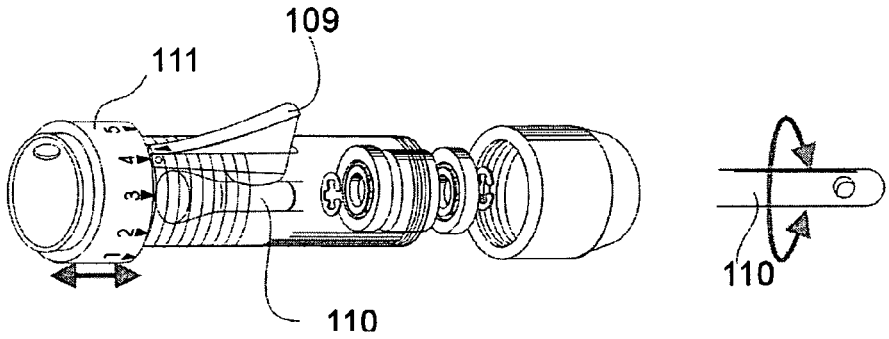
Figure 31A:
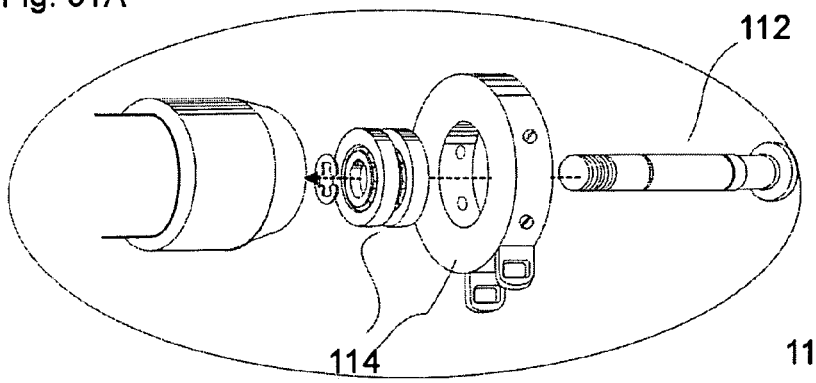
FIGS. 31A-31D and 32A-32B illustrate embodiments of the multi-exercise rotary device showing different means of creating progressive rotational resistance through friction.
Figure 31B:
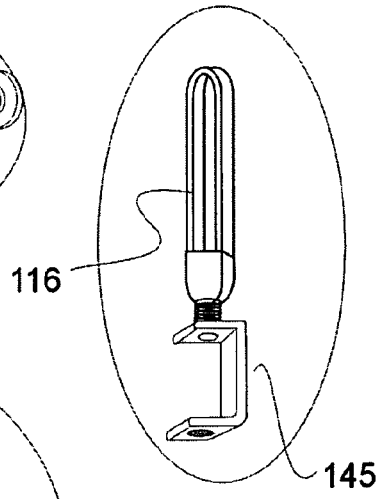
Figure 31C:
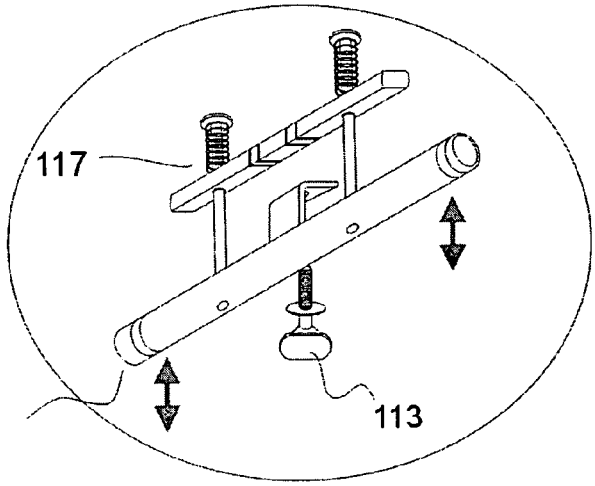
Figure 31D:
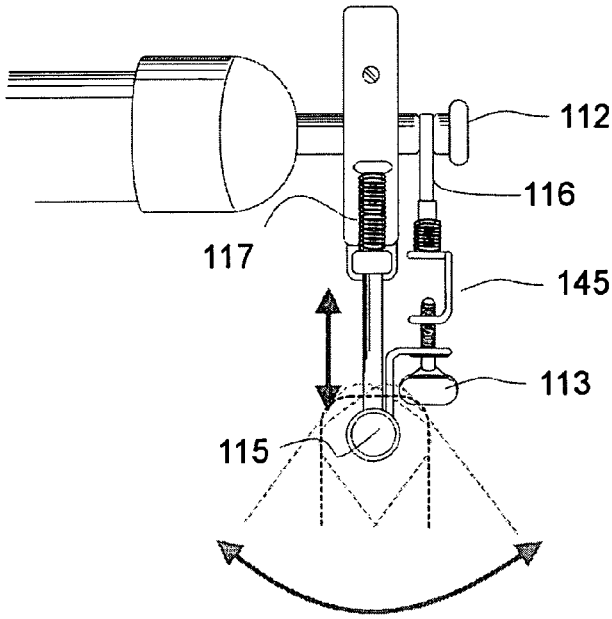

FIGS. 28, 29 and 30 also demonstrate various embodiments where rotational resistance is created through friction. FIG. 28 shows an axis assembly with bearings (95) and collet (96). The collet creates friction against the axis (97) when a tapered fitting (98) is turned. The collet adjustment components have markings (99) that allow the user to visually gauge the amount of rotational resistance applied. This is useful when adjusting and synchronizing two hand-held exercise devices. FIG. 29 uses a disc breaking system and a similar gauging device for adjustment. As a fitting (100) is turned, a spring (101) exerts force which pushes against a disc pad (102), which causes friction on an opposing disc (103) that spins with the axis (104). The disc pad is keyed (105) and is held in place by channels (106) in the housing (107), which connects to the hand-held member (108). FIG. 30 shows a pivoting wedge (109), which functions so as to make an adjustable frictional engagement on the axis-bearing assembly (110) in a manner similar to the disc brake pad. The fitting (111) that drives the wedge against the axis is similarly gauged.

FIG. 31 shows one embodiment where rotational friction is applied to a stationary axis (112). A drag clutch (FIG. 31B) with a thumbscrew adjustment (113) rotates around the axis as part of the bearing (114) and pivot (115) assembly. By tightening the thumbscrew adjustment, a friction-causing member (116) tightens around the axis. FIG. 31 further demonstrates one embodiment where progressive rotational resistance is incorporated into the friction-causing mechanism. The rotating member and thumbscrew adjustment are connected to a floating pivot (FIG. 31C). The pivot is suspended by spring-loaded shocks (117). As centrifugal force increases, the pivot pulls away from the axis causing the drag clutch to tighten. Manual adjustment to the drag clutch can be used in conjunction with progressive rotational resistance. By locking the spring-loaded shocks in place, the progressive resistance feature can be disengaged.

Figure 32A:
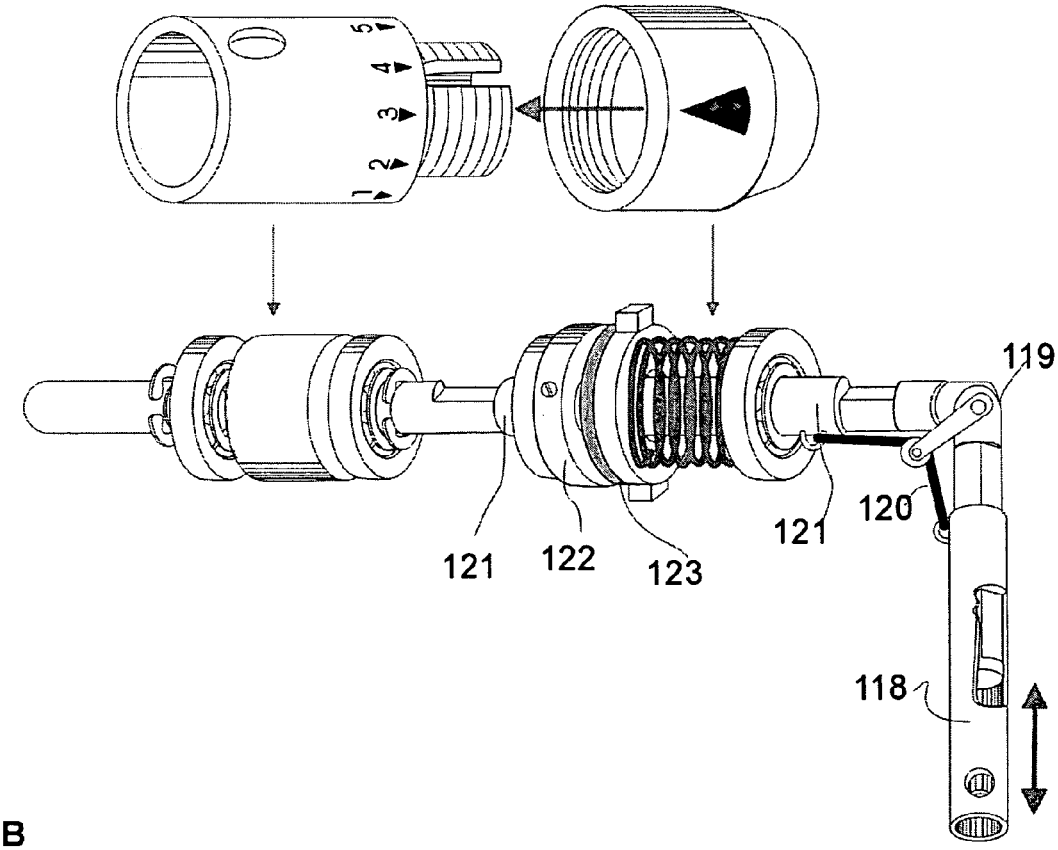
Figure 32B:
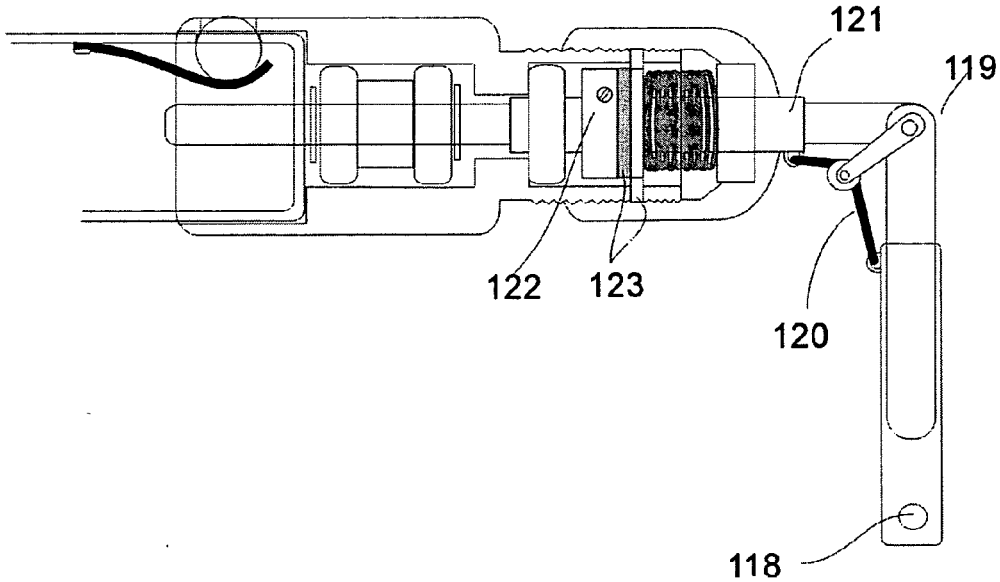

FIG. 32 further demonstrates an embodiment where progressive resistance is applied to a rotating axis design utilizing a disc breaking mechanism similar to the one shown in FIG. 29. As centrifugal force increases, a sleeve (118) at the end of the pivot (119) pulls away from the axis, causing tension in a weight-transferring member (120), which pulls a sleeve on the axis (121). The sleeve is connected to a disc (122), which is forced against a disc break pad (123) as the centrifugal force increases. Similar to FIG. 31, manual adjustment, utilizing the cited adjustment fitting, and progressive rotational resistance can be used in conjunction with one another. The progressive resistance feature can also be disengaged by locking the end sleeve on the pivot, preventing it from sliding.

FIG. 33 to FIG. 37 illustrate two embodiments of the invention where the connection member attachment allows two hand-held exercise devices to be used in a fashion similar to a jump rope. FIG. 33 shows a rope or cord with a ring and swivel assembly (124) on each end. The ring, in the form of a key ring, can be connected to a hole at the base of a rotating member (125), end of a pivot (126 of FIG. 36) or axis (127 of FIG. 37). FIG. 34 demonstrates a connection member attachment that is flat and elongated (128) rather than tubular. The planar design and semi-rigid composition helps minimize torque in the direction of rotation. As shown in FIGS. 35A and 35B, two holes (129) positioned linearly on each end of the attachment fit over two corresponding nodes (130) at the end of a rotating member. The nodes on the rotating member accept a retaining clip (131) that locks the connection member in place and in line with the rotating member. When rotational resistance is applied to the rotating member either through friction or air resistance, the connection member attachment is equally affected and remains in line with the rotating members.

Figure 38:
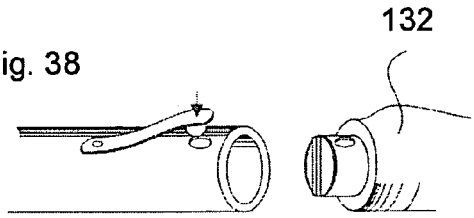
FIGS. 38 to 42 illustrate various embodiments of the extension member attachment.
Figure 39:
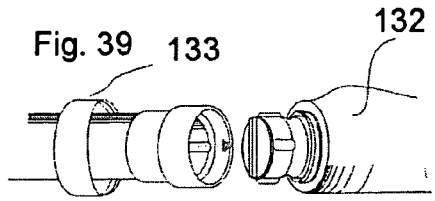
Figure 40:
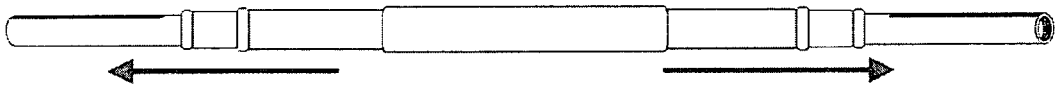

FIGS. 38 to 42 demonstrate different embodiments of the invention for of the extension member attachment, such as attachment member 5 noted above with respect to FIG. 4. The attachment member is connected preferably to the end of the hand-held member (132) of, one or more hand-held exercise devices. FIG. 38 demonstrates a ball retainer connection and FIG. 39, a keyed sleeve fitting connection, which is further secured by a threaded outer sleeve (133). One embodiment, FIG. 40, utilizes a segmented extension member design that allows its length to be adjusted by extension, and then secured by a twisting motion.

Figure 41:
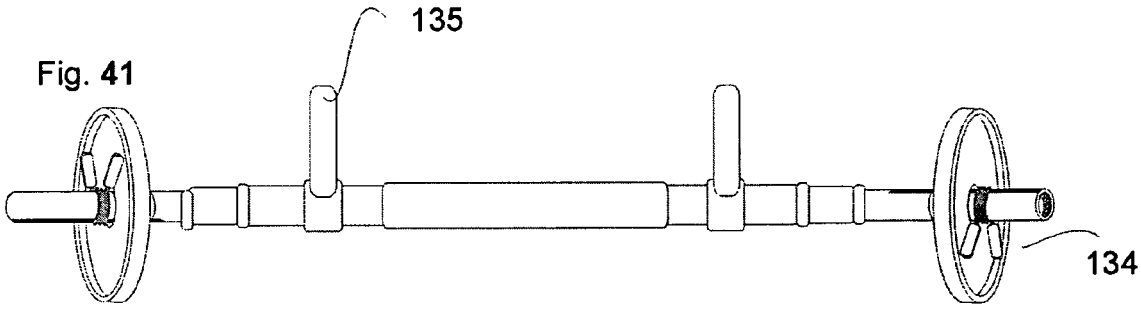
Figure 42:
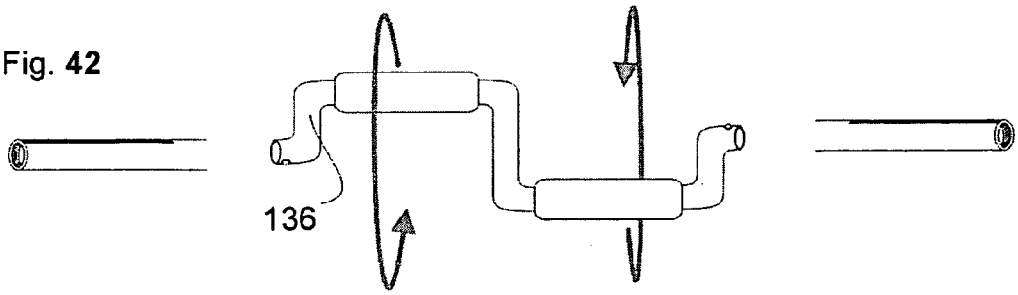
Figure 43:
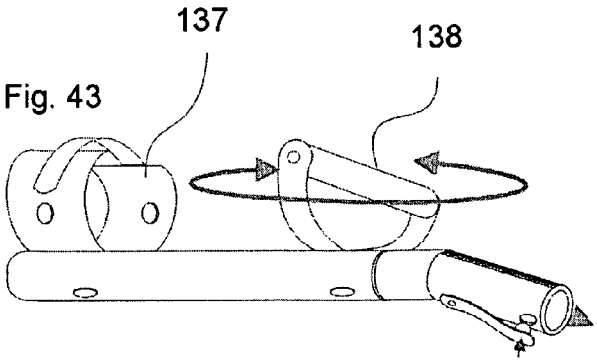
FIGS. 43 to 49 illustrate various embodiments of the brace attachment.

FIG. 41 shows an embodiment of the invention where weighted plates (134) can be added to each side of the extension member attachment. This feature allows the extension member to be used solely as a weight lifting aid or apparatus during interval training with the hand-held exercise device. The attachment also accepts various handles (135) allowing the user to vary handgrip. FIG. 42 shows an embodiment with a center section in the form of a double crank (136) that can be added to allow various paddling or even pedaling movements when the rotary device of the invention is powered by the legs of the user.

Figure 44:
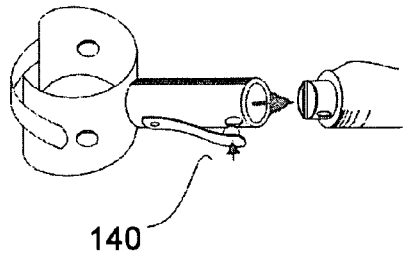
Figure 45:
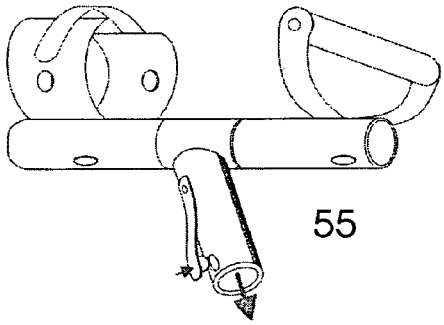
Figure 46:
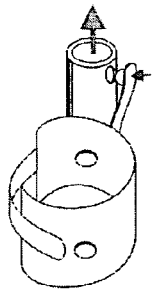
Figure 47:
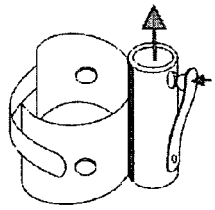
Figure 48:
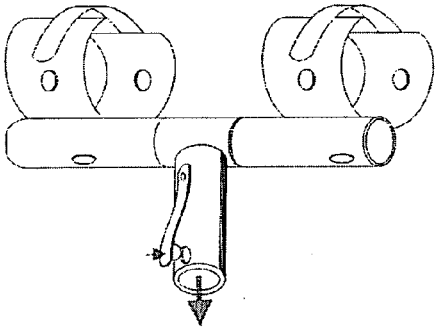
Figure 49:
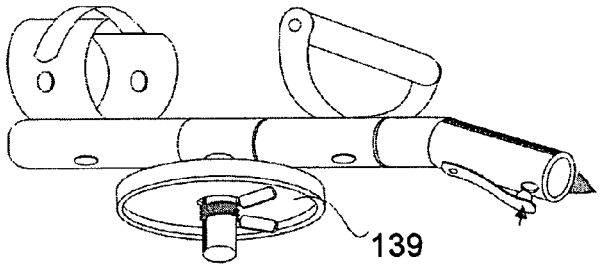

FIGS. 43 to 49 demonstrate various brace embodiments of the invention. The braces connect preferably to the end of the body-supported member of the rotary exercise device. The brace can consist of a strap (137) and handle (138) shown in FIGS. 43, 45 and 49. It may have two straps shown in FIG. 48, as to eliminate the need for using hands. FIGS. 44, 46 and 47 utilize a single strap design. FIG. 49 demonstrates a weighted plate (139) attachment. This feature allows the brace member to be used solely as a weight lifting aid or apparatus during interval training with the hand-held exercise device. Each embodiment shows how the user can vary the connection angle, connection placement and orientation to the user's limb. There are various means by which to secure the brace to the hand-held member, though each embodiment illustrates a ball retainer locking system (140). All the embodiment configurations shown can be achieved using a single brace design that incorporates interchangeable parts and adjustments.

Figure 50B:
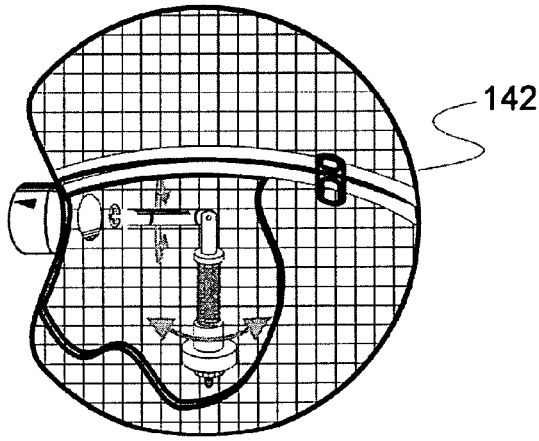

FIG. 50 demonstrates a closed design where the rotating member is housed in an enclosure. The enclosure can be solid (141), perforated or mesh (142). Solid enclosures may be transparent as to let light from an internal light-generating source, connected to the rotating member, project through the enclosure. FIG. 50B shows a rigid plastic mesh enclosure. Since the rotating members in either of the embodiments do not utilize air drag for rotational resistance, friction is used to control rotation. In FIG. 50A, a collet design (143) previously cited is used. In both embodiments, the enclosure is connected to the collet adjustment sleeve (144). By turning the enclosure, the collet can be tightened or loosened around the axis-bearing assembly. Additionally, both enclosures can be removed or opened, allowing for the adjustment and replacement of the rotating member and rotating member attachments.

While this invention has been particularly shown and described with references to preferred embodiments thereof, it will be understood by those skilled in the art that various changes in form and details may be made therein without departing from the sphere and scope of the invention. In fact, many such changes are already noted in this description but it should be realized that the above-noted changes were not exhaustive, and merely exemplary. Those skilled in the art will recognize, or be able to ascertain using no more than routine experimentation, many equivalents to the specific embodiments of the invention described herein.

The invention claimed is:

1. A multi-exercise rotary device, comprising:

at least one elongate body-supported member extending generally along a longitudinal axis, said body-supported member having a first end adapted to be supported by a portion of the body of a user of the device, and a second end opposite the first end;

at least one rotating member having a longitudinal axis that is at least semi-rigid, said rotating member including a planar surface adapted and intended to present a substantial air-resistance effect which is noticeable to the user in response to rotation of said rotating member;

a rotary mechanism for coupling the rotating member to a point on the body-supported member which is near the second end thereof, said rotary mechanism allowing rotational movement of the rotating member in a direction about the longitudinal axis of the body-supported member; and a device for constraining the angular movement between the longitudinal axis of the rotating member and the longitudinal axis of the body-supported member to be substantially only in a predetermined plane axially aligned with the body-supported member, and for constraining said plane from twisting with respect to the longitudinal axis of said body-supported member;

wherein said rotating member includes an airfoil having said planar surface thereon, and an angle adjustment means operable for making a noticeable change to the user in an amount of air being displaced by the airfoil to said user, said airfoil being adjustable by said angle adjustment means so as to set an angle that the planar surface of the airfoil makes with respect to the direction of rotation of the rotating member to one of a plurality of different angles, and thereby present a noticeably different one of a plurality of selectable air-displacement effects to the user in response to said rotational movement.

2. The multi-exercise rotary device of claim 1, wherein said device is a pivot incorporated as part of the said rotary mechanism.

3. The multi-exercise rotary device of claim 1, wherein said device is incorporated as part of the said rotating member.

4. The multi-exercise rotary device of claim 1, wherein said rotating member includes a coupling device for selectively coupling a selected one of a plurality of selectable rotating members to said rotary mechanism.

5. The multi-exercise rotary device of claim 1, which further includes a user adjustable rotational resistance means.

6. The multi-exercise rotary device of claim 1, wherein said angle adjustment means is included as part of said airfoil.

7. The multi-exercise rotary device of claim 1, wherein said angle adjustment means includes a detachable coupling device which allows for replacement of the rotating member with one having a different angle with respect to the direction of rotation of the rotating member, and thereby air-displacement characteristic for the planar surface thereof.

8. The multi-exercise rotary device of claim 5, wherein said user adjustable rotational resistance means includes a user adjustable friction-generating means for generating an adjustable amount of friction between rotating and non-rotating parts of said rotary mechanism.

9. The multi-exercise rotary device of claim 1, wherein said rotating member includes a weighting means for allowing the user to vary the weight and radial weight distribution of the rotating member.

10. The multi-exercise rotary device of claim 9, wherein said weighting means includes removably attachable weights that can be positioned radially in or on the rotating member so as to vary weight and weight distribution of the rotating member, thereby allowing the user to simulate a variety of speed and jump rope exercises.

11. The multi-exercise rotary device of claim 9, wherein said weighting means includes one or more weight units, each comprised of one of an aggregate or a solid which can be removably attached to the said rotating member.

12. The multi-exercise rotary device of claim 9, wherein said weighting means includes chambers built into the rotating member, so that one of a fluid or an aggregate can be introduced into said chambers to adjust said weight and radial distribution of said rotating member.

13. The multi-exercise rotary device of claim 1, wherein at least a portion of said rotating member comprises a soft, impact absorbing material, which helps minimize damage or injury to persons or objects that may come into accidental contact with the rotating member during use.

14. The multi-exercise rotary device of claim 1, wherein said body supported member is a hand held member having an outer layer contoured to the shape of a users hand.

15. The multi-exercise rotary device of claim 1, wherein said hand held member includes a rotation gauging device adapted to produce a sound with each rotation of said rotational member.

16. The multi-exercise rotary device of claim 1, wherein one of said rotary mechanism or said rotating member includes a means of generating and projecting light.

17. The multi-exercise rotary device of claim 1, wherein said body supported member includes a fastening means that helps secure the body supported member to a portion of the user's body.

18. The multi-exercise rotary device of claim 1, further including a coupling member which allows two of said body supported members to be coupled together.

19. The multi-exercise rotary device of claim 1, farther including a housing in which said rotating member rotates.

20. A multi-exercise rotary device, comprising:

at least one body-supported member extending generally along a longitudinal axis, said body-supported member having a first end adapted to be supported by a portion of a body of the user, and a second end opposite the first end;

at least one rotating member having a longitudinal axis that is at least semi-rigid, said rotating member including a planar surface adapted and intended to present a substantial air-resistance effect in response to rotation of said rotating member;

a rotary mechanism for coupling the rotating member to a point on the body-supported member which is near the second end thereof, said rotary mechanism allowing rotational movement of the rotating member in a direction about the longitudinal axis of the body-supported member;

a device for constraining the angular movement between the longitudinal axis of the rotating member and the longitudinal axis of the body-supported member to be substantially only in a predetermined plane axially aligned with the body-supported member, and for constraining said plane from twisting with respect to the longitudinal axis of said body-supported member, and an angle adjustment means for adjusting the rotational resistance of the rotating member about the longitudinal axis of the body supported member, said an angle adjustment means being operable in its adjustment so as to set an angle that the planar surface of the rotating member makes with respect to the direction of rotation of the rotating member to one of a plurality of different angles, and thereby make a noticeable change in an amount of air being displaced by the planar surface, said amount being such that said planar surface presents a noticeably different one of a plurality of selectable air-displacement effects to the user in response to said rotational movement.

* * * * *